United States Patent [19]

Hartman

[11] Patent Number: 4,470,571

[45] Date of Patent: Sep. 11, 1984

[54] BOOK HOLDER EXTENDER

[76] Inventor: Don A. Hartman, 3022 E. 51st, Apt. 81, Tulsa, Okla. 74105

[21] Appl. No.: 389,403

[22] Filed: Jun. 17, 1982

[51] Int. Cl.[3] ..... A47B 97/04

[52] U.S. Cl. ..... 248/452; 248/453

[58] Field of Search ..... 248/452, 453, 451, 448, 248/449

[56] References Cited

U.S. PATENT DOCUMENTS

| | | | |
|---|---|---|---|
| 1,953,560 | 4/1934 | Johnson | 248/452 X |
| 2,001,139 | 4/1935 | Johnson | 248/453 |
| 3,719,284 | 3/1973 | Rasmusson et al. | 248/453 X |
| 4,275,863 | 6/1981 | Hartman | 248/452 X |

*Primary Examiner*—Ramon S. Britts
*Assistant Examiner*—Sarah A. Lechok
*Attorney, Agent, or Firm*—Head, Johnson & Stevenson

[57] ABSTRACT

An improved book holder having a backrest portion which connects a base plate for supporting the lower edge of an open book and a top plate which is adjustable to close toward and contact with the upper edge of the open book wherein the improvement comprises a plurality of extender means attached to either the base plate or the top plate and inclined such as to accept the hardbound cover of the open book at or near the backrest and to close inwardly upon the pages such as to make contact with the pages; such contact being made with friction pad members secured to the extender means for preventing the accidental page turning of the book. The use of such extenders in combination with the book holder allows the book holder to easily hold hardbound books, loose leaf pages in hard cover binders and the like.

2 Claims, 7 Drawing Figures

BOOK HOLDER EXTENDER

BACKGROUND OF THE INVENTION

1. Field of the Invention

The present invention relates to a book holder and more particularly, but not by way of limitation, to a holder for hardbound books, loose leaf pages in a hard binder and the like.

2. Description of the Prior Art

Various music book holders have been developed in the past but most use some variation of a pair of spring-loaded pivotal arm members which may be placed across the open pages of the book to hold it in an open position. While this solves the problem of keeping the book open to the desired page location, it is still difficult to turn the pages without an assistant or without removing both hands from the musical instrument in order to effect the page turning. The same general problem exists in cases where a person is hospitalized or attempting to read a book in bed, since it is next to impossible to keep the book open to the desired page location without grasping the book with both hands.

In U.S. Pat. No. 4,275,863, the present inventor disclosed a book holder which is particularly designed and constructed to support a book at its top and bottom edges to keep the book open to the desired page location and at the same time facilitate turning of pages in the book with minimal effort and with only the use of one hand. This device comprises an elongated base plate member which has an upwardly extending backrest portion secured along the rear edge of the base plate. This backrest member also comprises one or more vertical slots along the rear edge thereof. The music holder further comprises a top plate member positioned directly above the base plate, the rear edge of the top plate member having elongated rods or slats which are slidably and frictionally engageable with the slots of the backrest member. A plurality of inwardly facing friction pad members, usually made of a soft flexible material such as urethane foam, is provided along the upper surface of the base plate member and the lower surface of the top plate member.

When a book is placed in an open position on the base plate member, the bottom edge of the book rests on the friction pads. The pads tend to prevent the pages from closing or turning accidentally. The top plate member is then adjusted downward so that similar pads spaced along the bottom surface thereof come into contact with the upper edge of the open book. These friction pads or pressure pads prevent the pages from accidentally turning, while at the same time when the user is ready to turn a page, it is turned in an ordinary manner by moving the right hand page to the left hand position and applying enough pressure to slip that page between the pressure pads thereby again keeping the book at the new desired page location.

Thus the book holder of U.S. Pat. No. 4,275,863 was primarily developed for use as a music book holder or use with flexible cover books and as such is not entirely acceptable for use with hardbound books or loose leaf pages held in a hard binder and the like.

SUMMARY OF THE INVENTION

The present invention provides a book holder extender which is particularly designed and constructed to attach to a book holder (such as described in U.S. Pat. No. 4,275,863) and hold open a hard covered book, loose leaf notebook and the like at the desired page location and at the same time facilitate turning the pages of the book with minimal effort and with only one hand. In general, the book holder to which the present book holder extenders are to be attached, comprises a base plate for supporting the lower edge of an open book, a backrest attached to the rear of the base plate and a top plate slideably attached to the backrest such that the top plate can be adjusted with respect to the base plate and make contact with the upper edge of the open book. As such, the top plate and the base plate form a pair of essentially parallel horizontal flat surfaces that adjust to make contact with the top and bottom edges of the open book.

The book holder extenders of the present invention (extender means) are devices that attach to the book holder (preferably to the top and base plates) and form an inclined surface at the base plate and at the top plate such as to accept the hardbound cover of the open book at a position on the extender means near the backrest. The inclined surfaces of the extender means slope upward from the base plate and downward from the top plate relative to a displacement away from the backrest such as to make contact with the pages of the open book. Each extender means has a friction pad member secured to the extender means which makes contact with the pages of the open book for preventing accidental page turning of the book.

In one embodiment of the invention, the extender means are removably attached to the base plate and/or top plate. Preferably this is accomplished by providing the top plate and base plate with friction pads that compress into recesses in the respective plates thus exposing a rearwardly positioned edge which operatively inserts and engages with a groove in the rearward upper portion of the extender means thus retaining the extender means in an inclined position.

It is a primary object of the present invention to provide a book holder extender means that allows a hard covered book or the like to be held in the book holder. It is an additional object that the extender means be detachable or retractable thus allowing the book holder to be used for both flexible covered and hard covered books. Fulfillment of these objects and the presence and fulfillment of other objects will be apparent upon complete reading of the specification and attached claims when taken in conjunction with the attached drawings.

DESCRIPTION OF THE PREFERRED EMBODIMENTS

Figure 1:
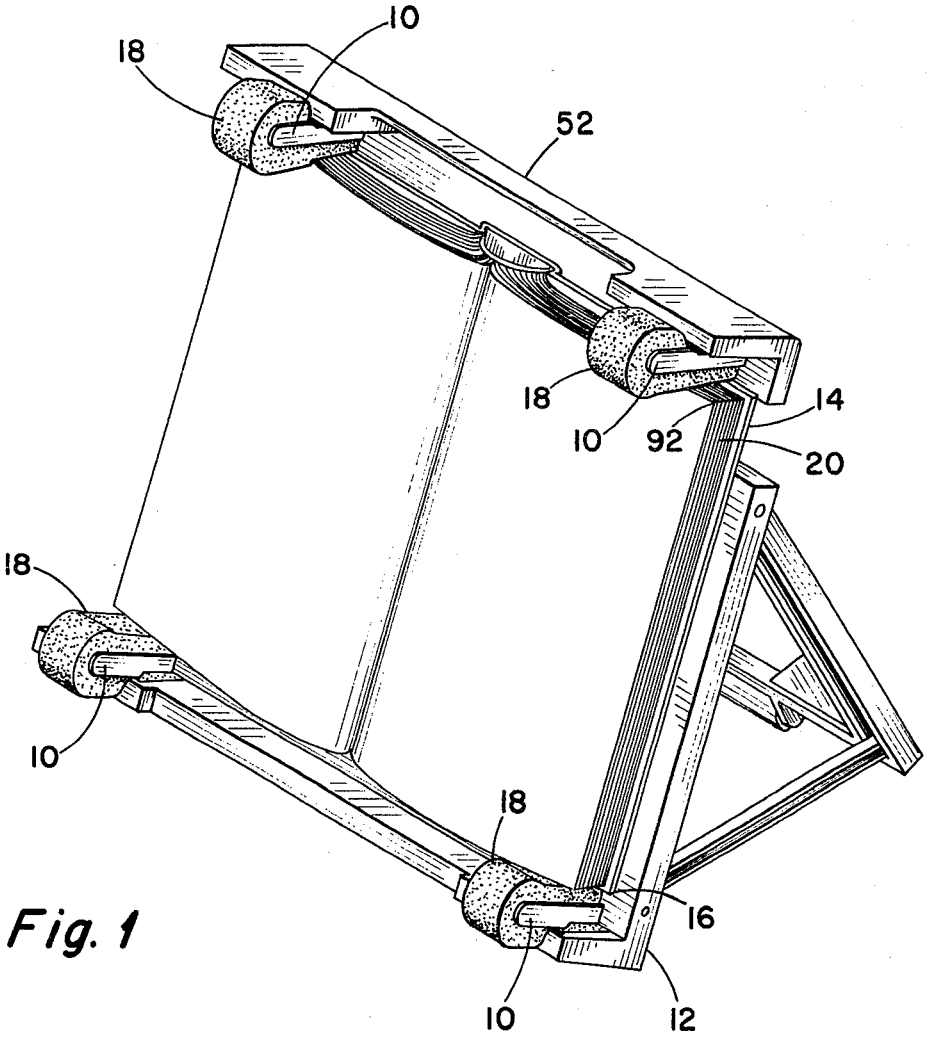
FIG. 1 is a perspective view of a book holder with book holder extenders of the present invention and having an open hard covered book mounted therein.
Figure 3:
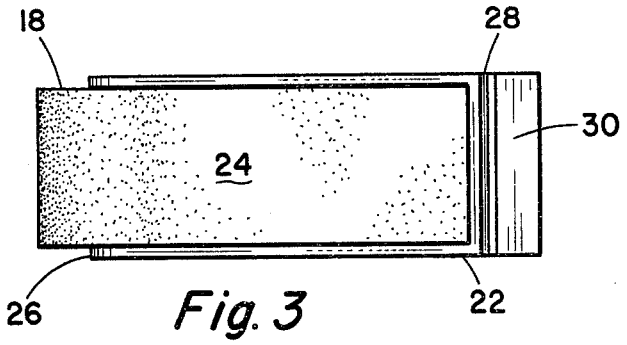
FIG. 3 is a top view of the book holder extender of FIG. 2.
Figure 2:
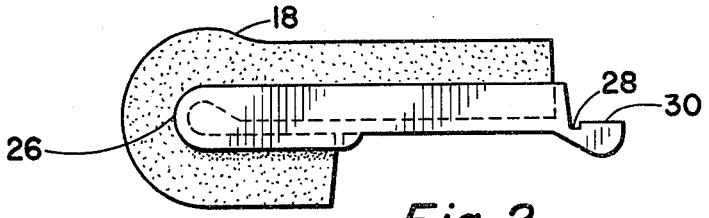
FIG. 2 is a side view of a book holder extender according to the present invention.

Referring to the drawings in detail, FIG. 1 illustrates the book holder extenders 10 attached to a book holder 12 holding a hard covered book 14. As illustrated, the lower edge 16 of the hard cover of book 14 rests on the back edge of book holder extenders 10 while the resilient friction pads 18 attached to each book holder extender 10 slope inward making contact with pages 20 of the book. As illustrated in FIGS. 2 and 3, the book holder extender 10 is preferably a detachable member made up of a rigid structural central element 22 that has a resilient friction pad 18 attached across the top flat surface 24 and wrapped around the outer edge 26. At the rear of the extender 10 is a groove 28 molded or manufactured into the step or ledge 30 of the structural element 22.

As illustrated in the figures, the book holder 12 to which the extenders 10 are attached generally comprises an elongated substantially flat base plate member 32 having one edge thereof designated the rear edge 34 and one surface thereof designated as the upper surface 36. A substantially rectangular flat backrest member 38 is secured to the upper surface 36 of the base plate adjacent to the rear edge portion 34 thereof. It is noted that the backrest member 38 can be made from a plastic type material and can be injection molded as an integral part of the base plate member 32. Similarly the central structural element 22 of the extenders 10 can be made of plastic or the like.

The backrest 38 further comprises an elongated rectangular slot 40 along the back surface thereof, the slot 40 being centrally positioned. The material surrounding the elongated reactangular slot 40 may be molded from the same plastic piece as that of the backrest 38. A spaced pair of rectangular friction pads or pressure pads 42 and 44 are secured in recesses 46 and 48 and attached to the interior surface of the base plate 32. These pressure pads are to be constructed of a very soft flexible material such as urethane foam for purposes that will be hereinafter set forth.

The book holder also comprises an elongated substantially flat top plate 52 also having one edge designated as the rear edge 54 and an inner surface 56. An elongated slat member 58 is secured to the inner surface 56 of the top plate 52 near the rear edge 54 thereof. The cross-sectional shape of said slat 58 is substantially the same as the cross-sectional shape of the elongated slot 40 of the backrest 38. Near the lower end of slat member 58 and to either side is a pair of forwardly extending drag elements 60 and 62 which make contact with the inner walls of slot 40 stabilizing the sliding action and adjustment feature of the book holder. In the central lower end of slat member 58 is a rearwardly extending stop element 64 that engages stop 66 within slot 40 and prevents the accidental withdrawal of slat member 58. A hole 68 is provided in backrest 38 to disengage stop element 64 from stop 66 when removal of slat member 58 is desired.

Figure 6:
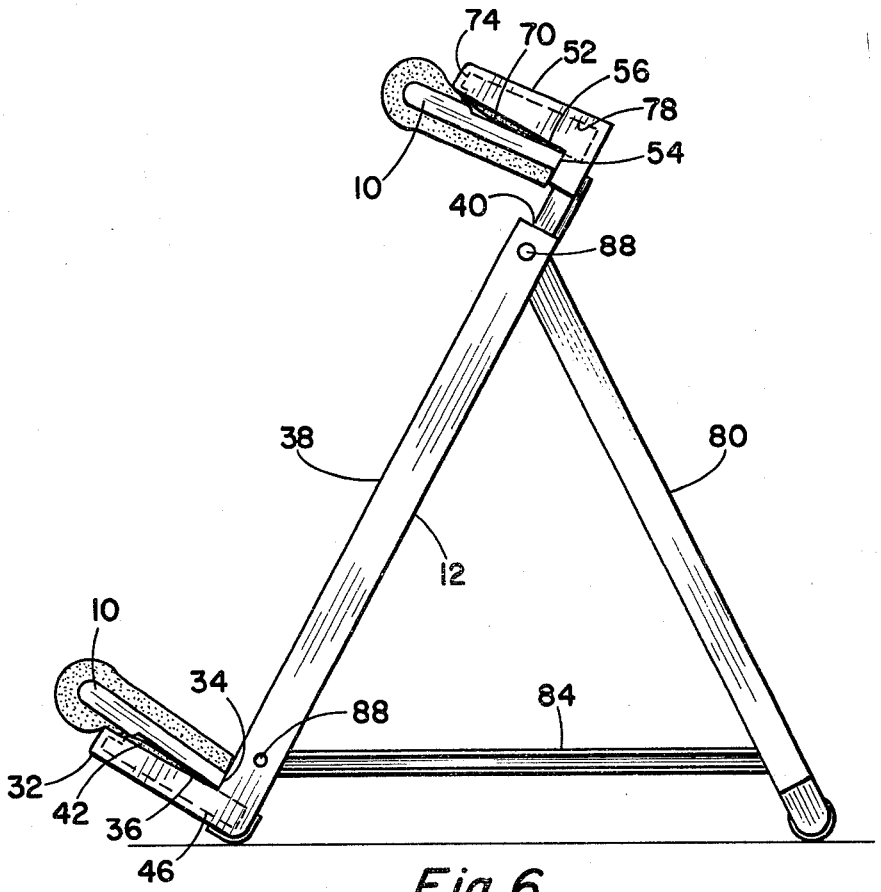
FIG. 6 is a side elevational view of the book holder of FIG. 1.
Figure 5:
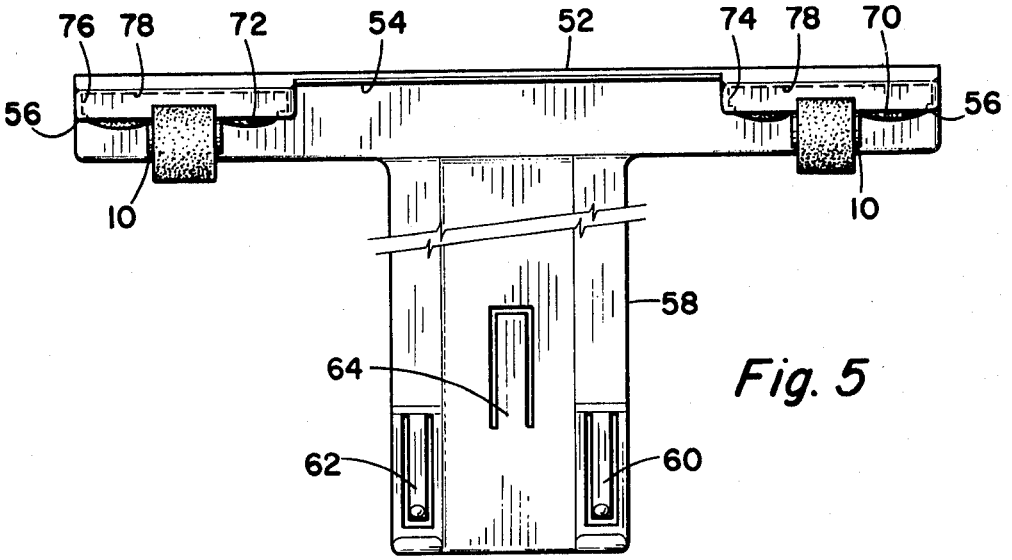
FIG. 5 is a detailed front elevational view of the top plate member of the book holder of FIG. 1.
Figure 4:
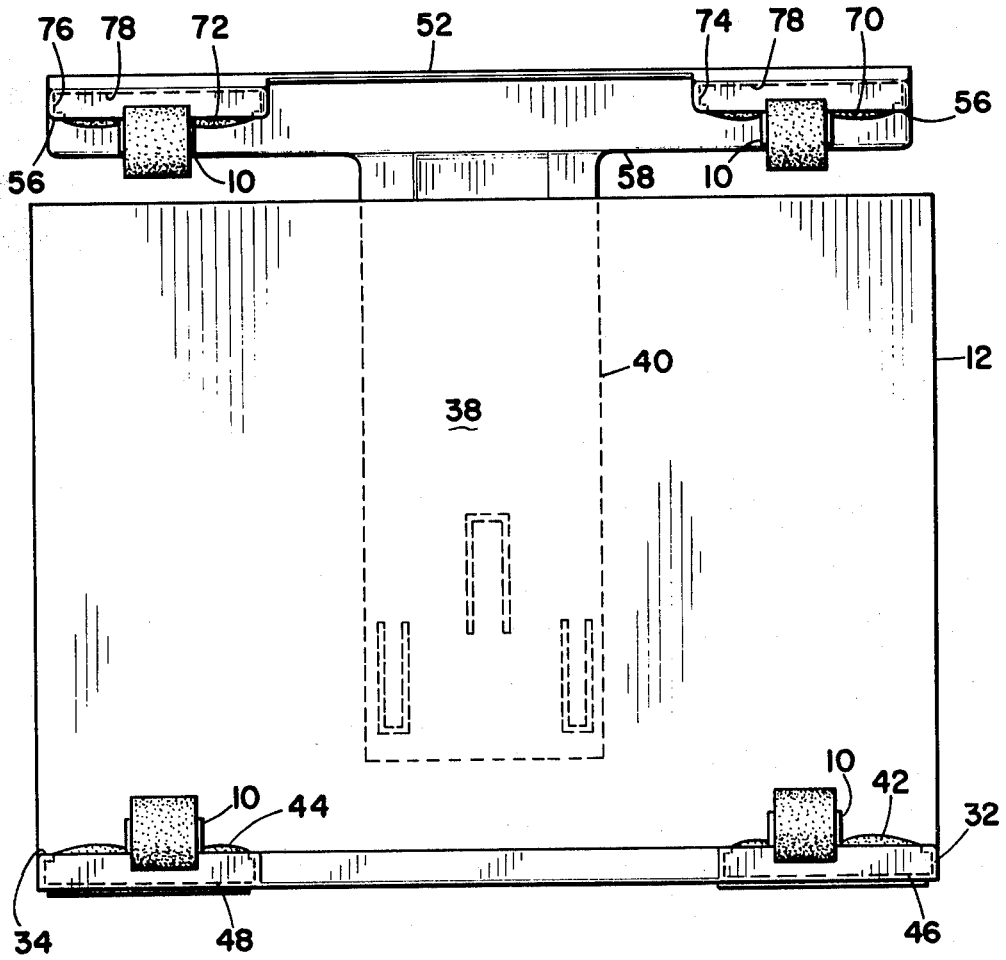
FIG. 4 is a front elevational view of the book holder of FIG. 1.

The inner surface 56 of top end plate 52 is provided with a pair of spaced friction or pressure pads 70 and 72, these pads being of soft pliable material such as urethane foam. The pads 70 and 72 are secured in recesses 74 and 76 and attached to the interior surface 78 of the top plate 52. As illustrated in FIG. 6 the recesses 46, 48, 74 and 76 (only 46 and 74 being visible) extend rearward and terminate at rear edges 34 and 54. As the respective resilient pads within these recesses are compressed, the perpendicular surfaces of backrest 38 and slat member 58 serve to engage groove 28 of the respective extender 10 inserted into the recess and hold the extenders at an appropriate slope or incline to allow the friction pads 18 to make contact with the pages of the book. In this manner the book holder extenders 10 can be inserted into the recess (attached to the book holder) when a hard covered book or the like is to be used, and they can be removed allowing the original friction pads in the recess to be used for flexible covered books as described in U.S. Pat. No. 4,275,863.

Figure 7:
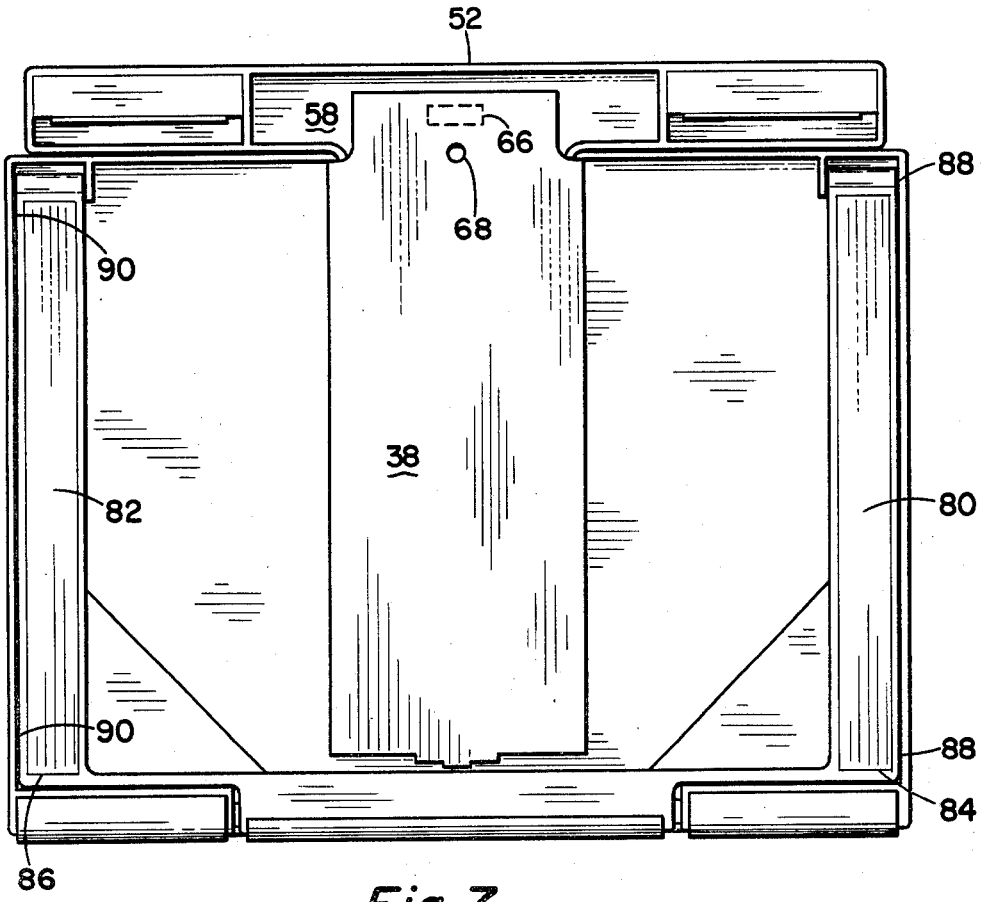
FIG. 7 is a backside collapsed view of the book holder of FIG. 1 with book holder extenders removed.

As further illustrated in FIGS. 6 and 7, the book holder can be equipped with interlocking legs 80 and 82 and leg braces 84 and 86 which are pivotally attached to the backrest at 88 and 90. When in use, the legs and braces extend as shown in FIG. 6 and then retract into the back of the book holder 12 as seen in FIG. 7.

In use, a book 14 may be opened to a desired page location, the lower edge of the book resting on the back edge of the book holder extenders 10 (see FIG. 1). The top plate 52 is then adjusted to bring the friction pads 18 into contact with the upper edge of the book 14. The frictional characteristics of the urethane foam pads will maintain the book in an open position. When it is desirable to turn the page, one need merely to grasp the upper right corner of the page 92 and pull that page over to the left side of the holder. The page may be easily pulled out of frictional contact from the pads 18 on the right and when turned over to the left side may be gently pushed into contact with the pads 18 on the left.

Having thus described the invention with a certain degree of particularity, it is manifest that many changes can be made in the details of construction and arrangement of components without departing from the spirit and scope of this disclosure. Thus is to be understood that the book holder extenders can be easily pivotally attached to the book holder thus rotating back into the backrest or the like when not in use. Furthermore the book holder as a whole can be permanently or reversibly attached to a variety of support structures well known in the art. Therefore, it is to be further understood that the invention is not to be limited to the embodiments set forth for purposes of exemplification, but is to be limited only by the scope of the attached claims, including a full range of equivalents to which each element thereof is entitled.

I claim:

1. In a book holder comprising a base plate for supporting the lower edge of an open book, a backrest attached to the base plate and a top plate slidably attached to the backrest such that said top plate can be adjusted with respect to the base plate and make contact with the upper edge of said open book and wherein the base plate and top plate are provided with friction pads which make frictional contact with the pages on an open book and which compress into recesses in said top plate and base plate thus exposing a rearwardly positioned edge, the specific improvement comprising:

(a) a plurality of extender means attached to said book holder wherein said extender means operatively insert into a groove in the rearward portion of said extender means such that said extender means forms an inclined surface at the base plate nd at the top plate such as to accept the hardbound cover of said open book at a position on the extender means near said backrest and said inclined surfaces slope upward from said base plate and downward from said top plate relative to a displacement away from said bookrest such as to make contact with the pages on said open book; and (b) a frictional pad member secured to said extender means which makes contact with said pages of said open book for preventing the accidental page turning of said book.

2. An improved book holder of claim 1 wherein said friction pad members are made of foamed urethane.

* * * * *